US009779600B2

(12) United States Patent
Sayegh et al.

(10) Patent No.: US 9,779,600 B2
(45) Date of Patent: Oct. 3, 2017

(54) ANTI-THEFT TAG

(71) Applicant: USS Technologies, LLC, Rancho Cucamonga, CA (US)

(72) Inventors: Adel O. Sayegh, Rancho Cucamonga, CA (US); Marc Trincale, Rancho Cucamonga, CA (US); Michael Sayegh, Rancho Cucamonga, CA (US); Zhaolian Wu, Hangzhou (CN); Daqiang Xia, Hangzhou (CN)

(73) Assignee: USS Technologies, LLC, Rancho Cucamonga, CA (US)

( * ) Notice: Subject to any disclaimer, the term of this patent is extended or adjusted under 35 U.S.C. 154(b) by 0 days.

(21) Appl. No.: 14/752,088

(22) Filed: Jun. 26, 2015

(65) Prior Publication Data

US 2016/0379457 A1 Dec. 29, 2016

Related U.S. Application Data

(60) Provisional application No. 62/017,690, filed on Jun. 26, 2014.

(51) Int. Cl.
*E05B 73/00* (2006.01)
*G08B 13/24* (2006.01)

(52) U.S. Cl.
CPC ..... *G08B 13/2434* (2013.01); *E05B 73/0017* (2013.01)

(58) Field of Classification Search
CPC .. E05B 73/0017; E05B 73/00; E05B 73/0023; E05B 73/0029; E05B 73/0035; E05B 73/0047; E05B 73/0064; Y10T 70/5004; Y10T 70/5009; G08B 13/2434; G08B 13/2448; G08B 13/2451
See application file for complete search history.

(56) References Cited

U.S. PATENT DOCUMENTS

| | | | | |
|---|---|---|---|---|
| 4,483,049 | A * | 11/1984 | Gustavsson | E05B 73/0017 222/175 |
| 4,649,397 | A * | 3/1987 | Heaton | E05B 73/0017 116/211 |
| 4,670,950 | A * | 6/1987 | Wisecup | E05B 73/0017 116/200 |
| 4,812,811 | A * | 3/1989 | Asbrink | E05B 73/0017 340/571 |
| D492,215 | S | 6/2004 | Lu | |
| 6,754,939 | B2 * | 6/2004 | Belden, Jr. | E05B 73/0017 24/704.1 |
| 7,808,386 | B1 * | 10/2010 | Sayegh | E05B 73/0017 235/385 |
| 8,403,227 | B2 | 3/2013 | Day | |
| 2004/0172989 | A1 * | 9/2004 | Seidel | E05B 73/0064 70/57.1 |
| 2012/0204608 | A1 | 8/2012 | Sayegh et al. | |
| 2015/0048946 | A1 * | 2/2015 | Luo | E05B 73/0017 340/572.8 |

* cited by examiner

*Primary Examiner* — Van Trieu
(74) *Attorney, Agent, or Firm* — Milord A. Keshishian

(57) ABSTRACT

The present invention discloses a theft-deterrent tag, comprising a first member that has a fixed locking position in relation to a second member for securely engaging the theft-deterrent tag with an article, with the pressure exerted at tag engagement points and experienced by the article is commensurate with force exerted at the fixed locking position of the first member in relation to the second member and the article size.

22 Claims, 16 Drawing Sheets

ANTI-THEFT TAG

CROSS-REFERENCE TO RELATED APPLICATIONS

This application claims the benefit of priority of U.S. Utility Provisional Patent Application No. 62/017,690, filed Jun. 26, 2014, entire disclosure of which is expressly incorporated by reference herein.

It should be noted that where a definition or use of a term in the incorporated patent application is inconsistent or contrary to the definition of that term provided herein, the definition of that term provided herein applies and the definition of that term in the incorporated patent application does not apply.

BACKGROUND OF THE INVENTION

Field of the Invention

One or more embodiments of the present invention are related to loss prevention and theft-deterrent tags and, more particularly, to tags that secure onto articles without damaging or altering the articles, and allow the presence of the articles to be detected (if they include markers) by compatible Electronic Article Surveillance (EAS) equipment.

Description of Related Art

It is a common practice for retail stores to protect articles with EAS tags to prevent theft of the article by shoplifters. One method of securing an EAS tag to an article includes using a grip mechanism to frictionally engage an article to prevent unauthorized removal of the tag from the article. However, most such EAS tags use a ratchet mechanism to assert a one-direction pressure onto the article at tag engagement points of the grip mechanism. A locking position of the engagement points and hence, the pressure experienced by the article at that particular locking position is dictated by the amount of force exerted by a user on the ratchet mechanism that moves the tag engagement points. That is, the ratchet mechanisms allow one-direction motion of the tag engagement points to engage with the article, with a travel distance of the engagement points to some locking position dictated by the force exerted by the user. Accordingly, the locking position and therefore, the strength of engagement with an article varies and is dependent on the user-exerted force on the tag. If the user does not exert sufficient pressure, the locking position of the tag engagement points will loosely engage the EAS tag with the article, leaving the article prone to theft by easy removal of the EAS tag.

There remains a long standing and continuing need for an advance in the art of EAS and theft deterrent tags that makes the tags more difficult to defeat, simpler in both design and use, more economical and efficient in their construction and use, and provide a more secure and reliable engagement of the article to be monitored without damaging or permanently altering the article.

BRIEF SUMMARY OF THE INVENTION

A non-limiting, exemplary aspect of an embodiment of the present invention provides a theft-deterrent tag, comprising:

a first member that has a fixed locking position in relation to a second member for securely engaging the theft-deterrent tag with an article;

wherein: pressure exerted at tag engagement points and experienced by the article is commensurate with force exerted at the fixed locking position of the first member in relation to the second member and the article size.

Another non-limiting, exemplary aspect of an embodiment of the present invention provides a theft-deterrent tag, comprising:

a first member that is levered in relation to a second member at a fulcrum;

the first member accommodates a marker, forming an Electronic Article Surveillance (EAS) tag;

the first member includes:

a keeper of a lock mechanism for allowing a lock member associated with the second member to lock onto the keeper and lock the first member in a fixed locking position in relation to the second member; and a retainer for engaging an article, with the retainer accommodating a biasing mechanism that enables the levered relationship between the first member and the second member;

the second member includes an opening for securing the article when the retainer engages the article and the first member is locked in relation to the second member against a biasing force of the basing mechanism.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention.

Further, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

Figure 1:
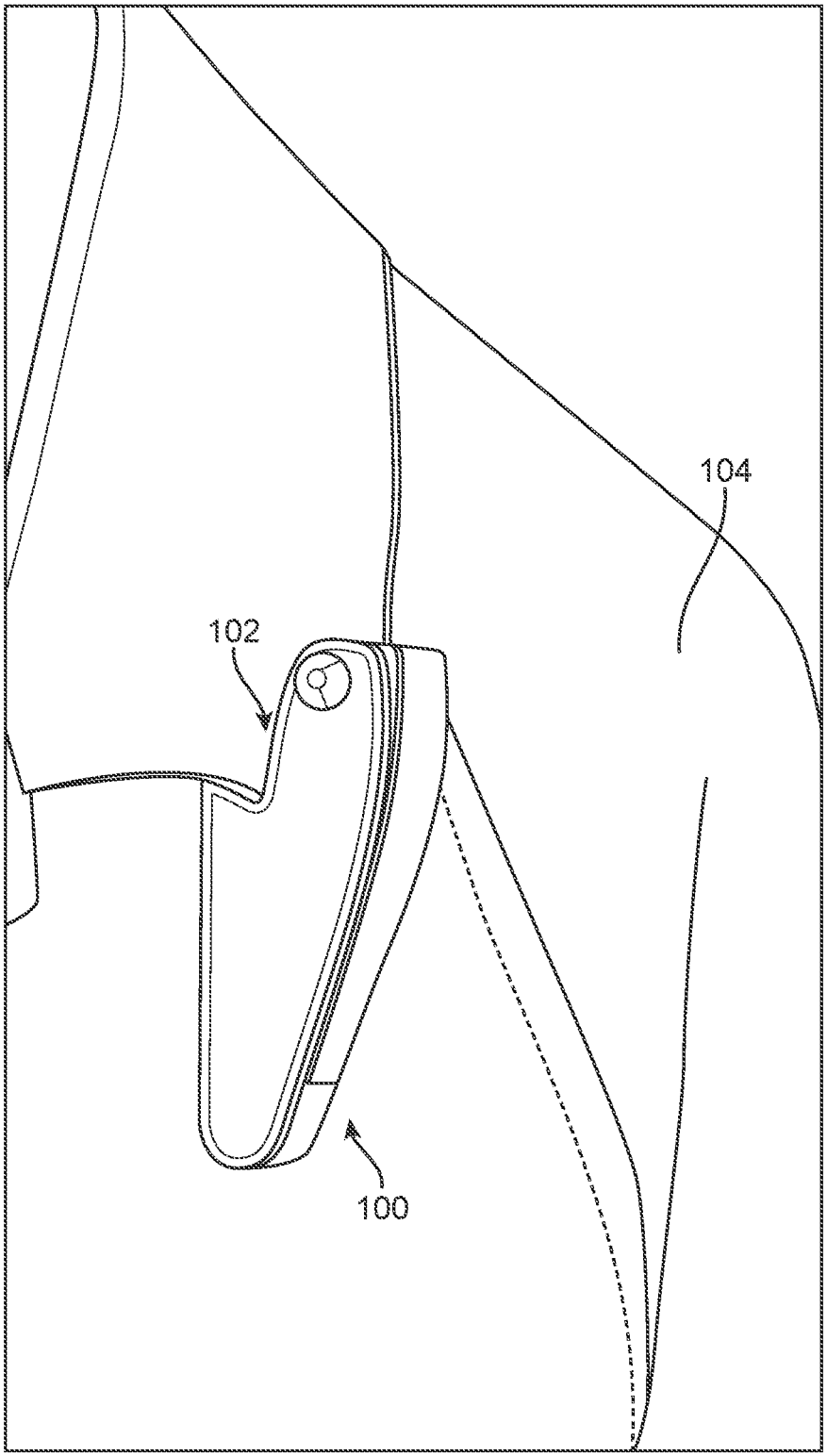
FIG. 1 is a non-limiting, exemplary illustration of an theft deterrent tag associated with an article in accordance with one or more embodiments of the present invention.
Figure 2A:
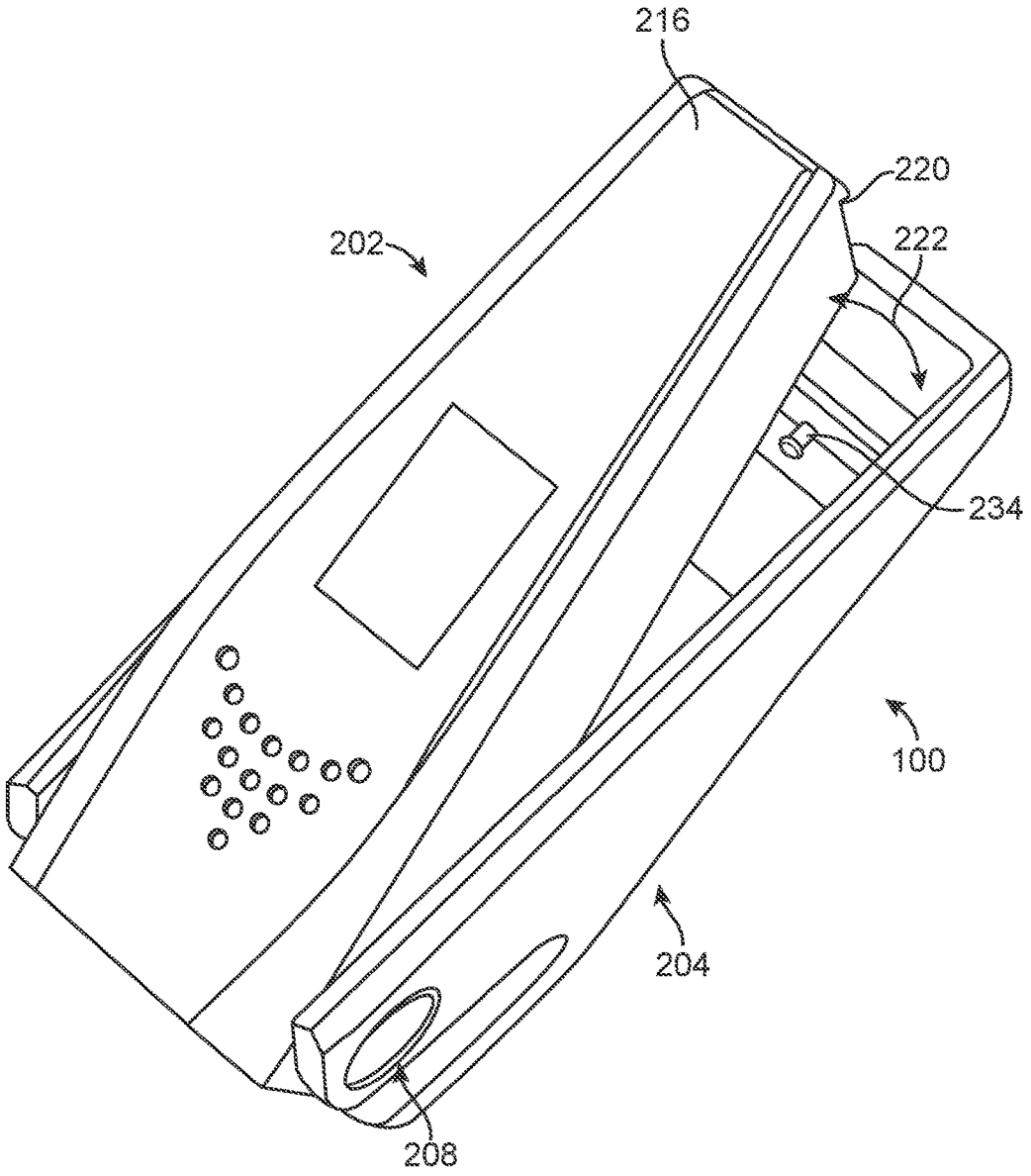
FIGS. 2A to 2K are non-limiting, exemplary illustrations of various views of the theft-deterrent tag illustrated in FIG. 1 in accordance with one or more embodiments of the present invention, with FIG. 2J illustrating a sectional view and FIG. 2K and exploded view.
Figure 2B:
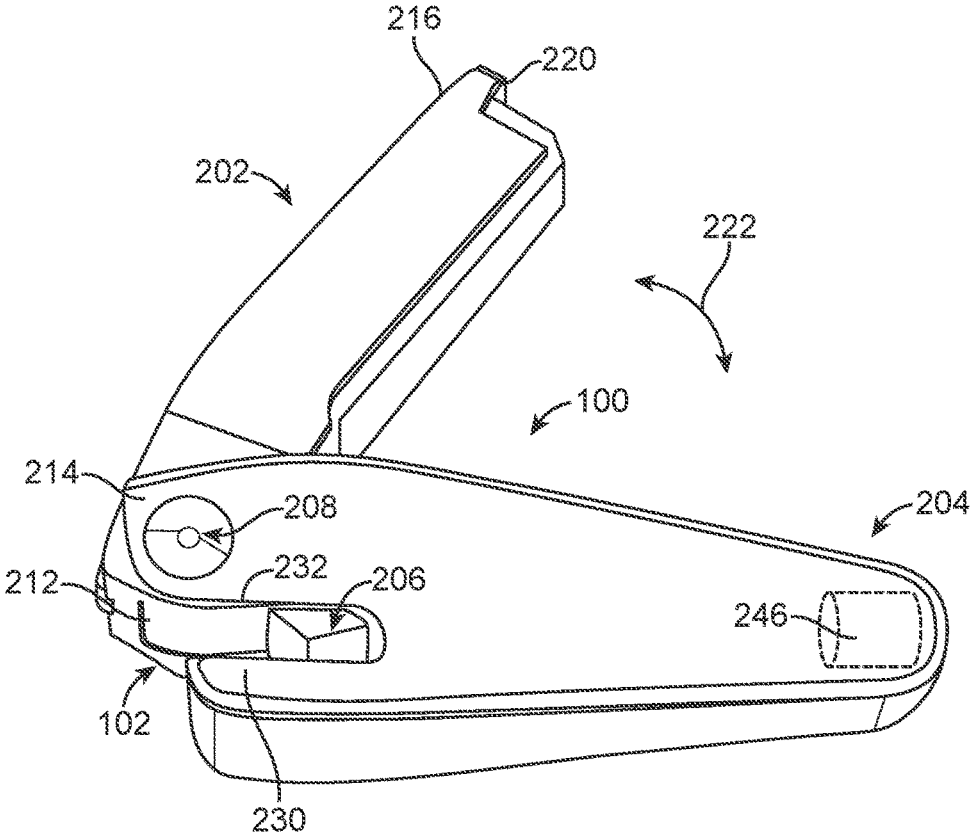
Figure 2C:
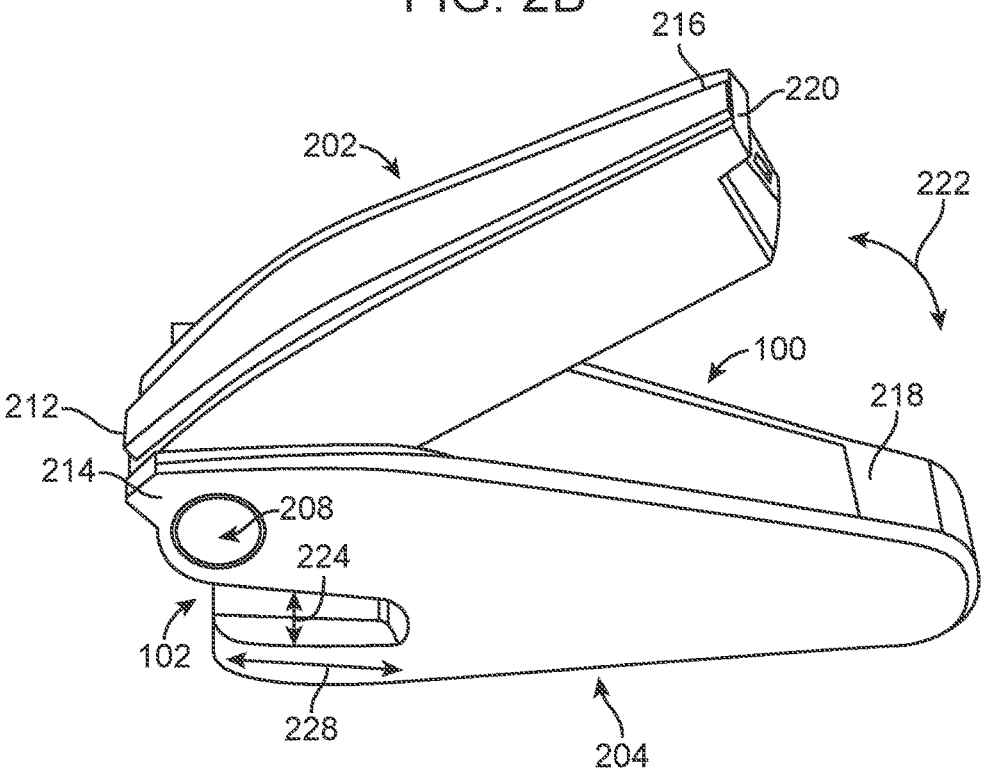
Figure 2D:
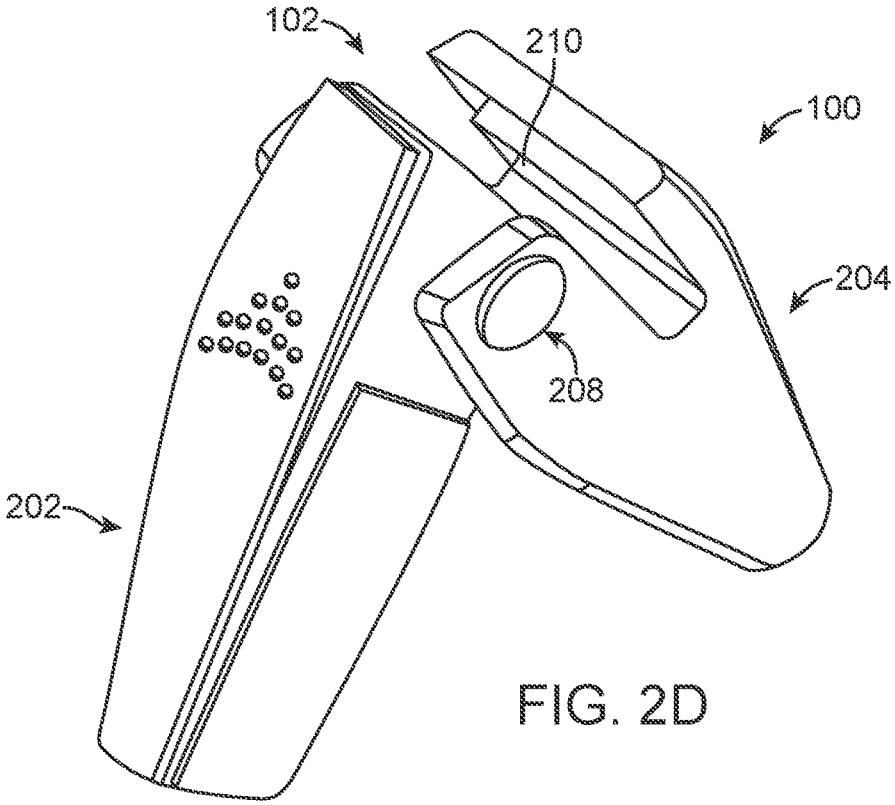
Figure 2E:
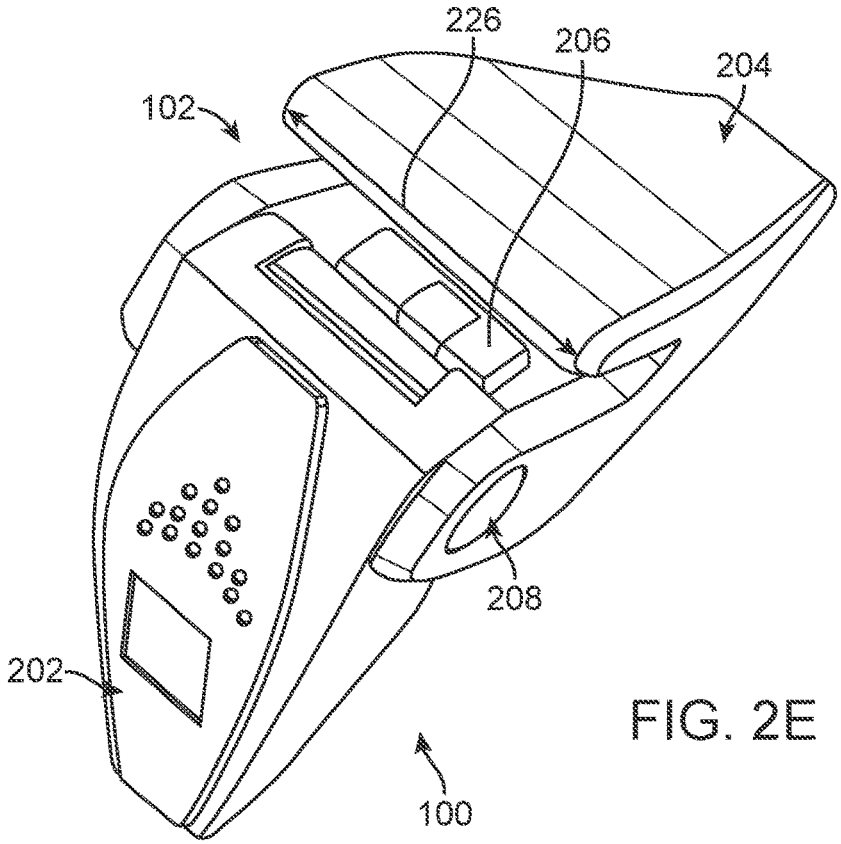
Figure 2G:
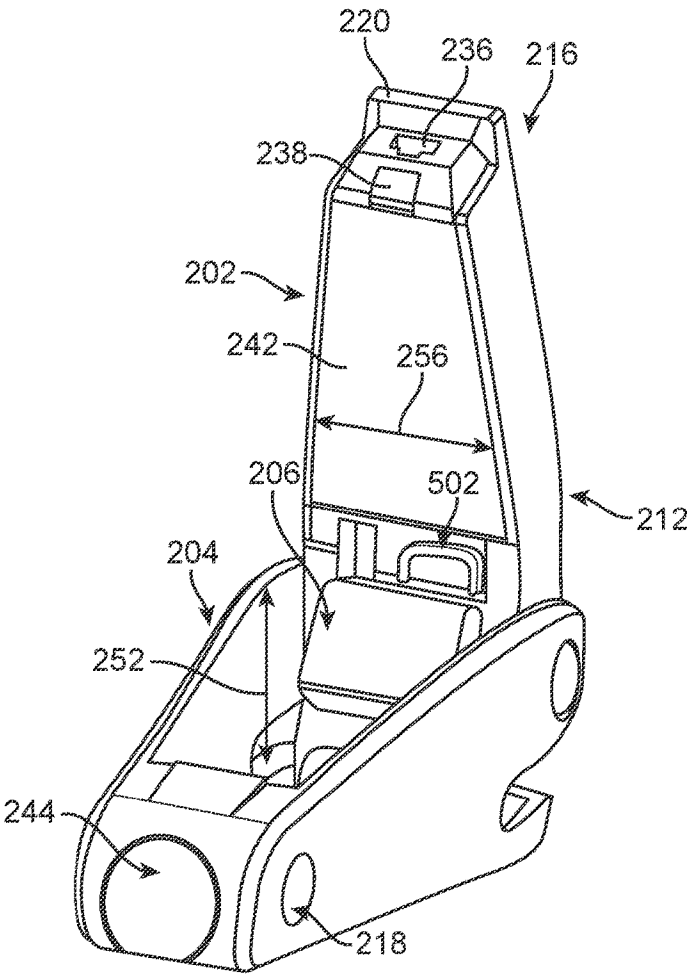
Figure 2F:
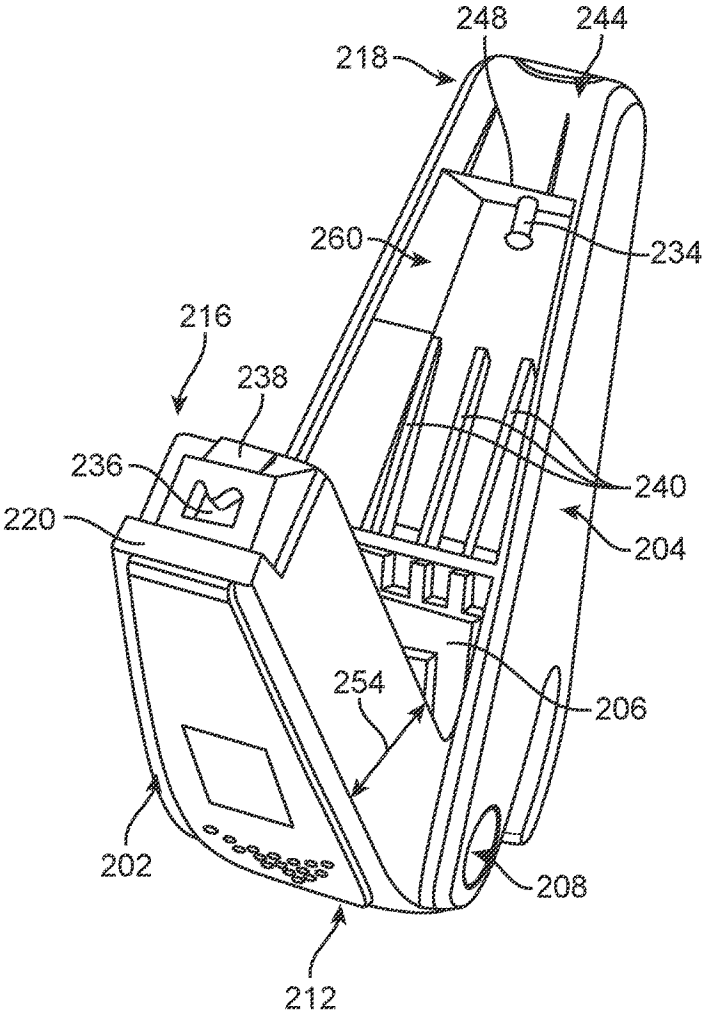

FIG. 1 is a non-limiting, exemplary illustration of a theft-deterrent tag associated with an article in accordance with one or more embodiments of the present invention. As illustrated in FIG. 1, a theft-deterrent tag 100 includes an opening 102 that accommodates a grip mechanism or retainer 206 (FIG. 2B, detailed below) to frictionally engage an article 104 to prevent unauthorized removal of tag 100 from article 104.

It should be noted that theft-deterrent tag 100 may accommodate an Electronic Article Surveillance (EAS) marker 304 (detailed below) and be referred to as EAS tag 100. However, theft-deterrent tag 100 without the EAS marker 304 or the like may also be used as a potential deterrent of theft. For convenience, the following will refer to theft-deterrent tag 100 (with or without a marker) as simply EAS tag 100.

Figure 2H:
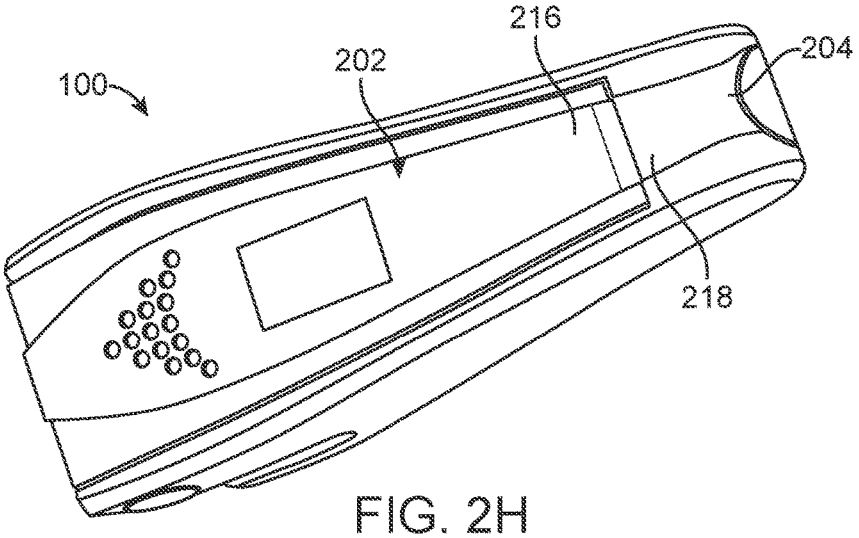
Figure 2I:
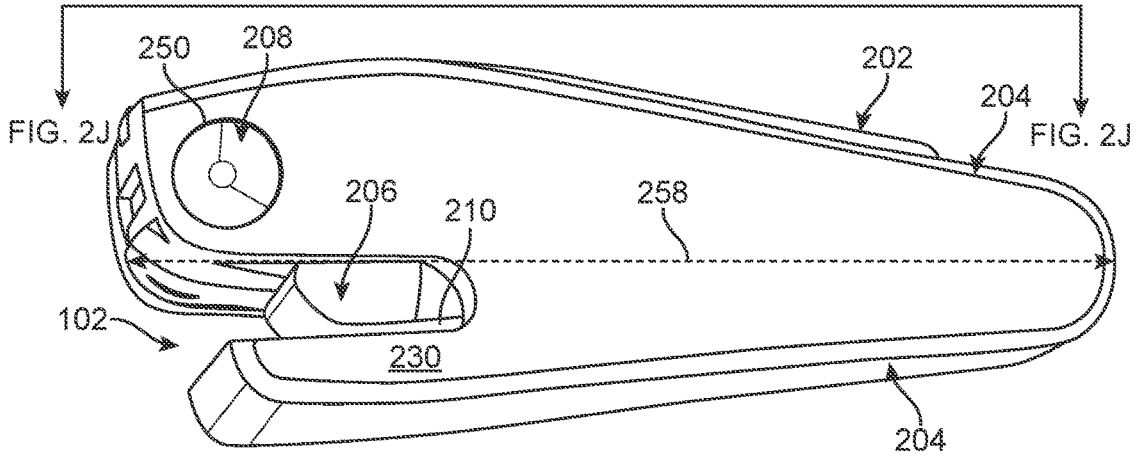
Figure 2J:
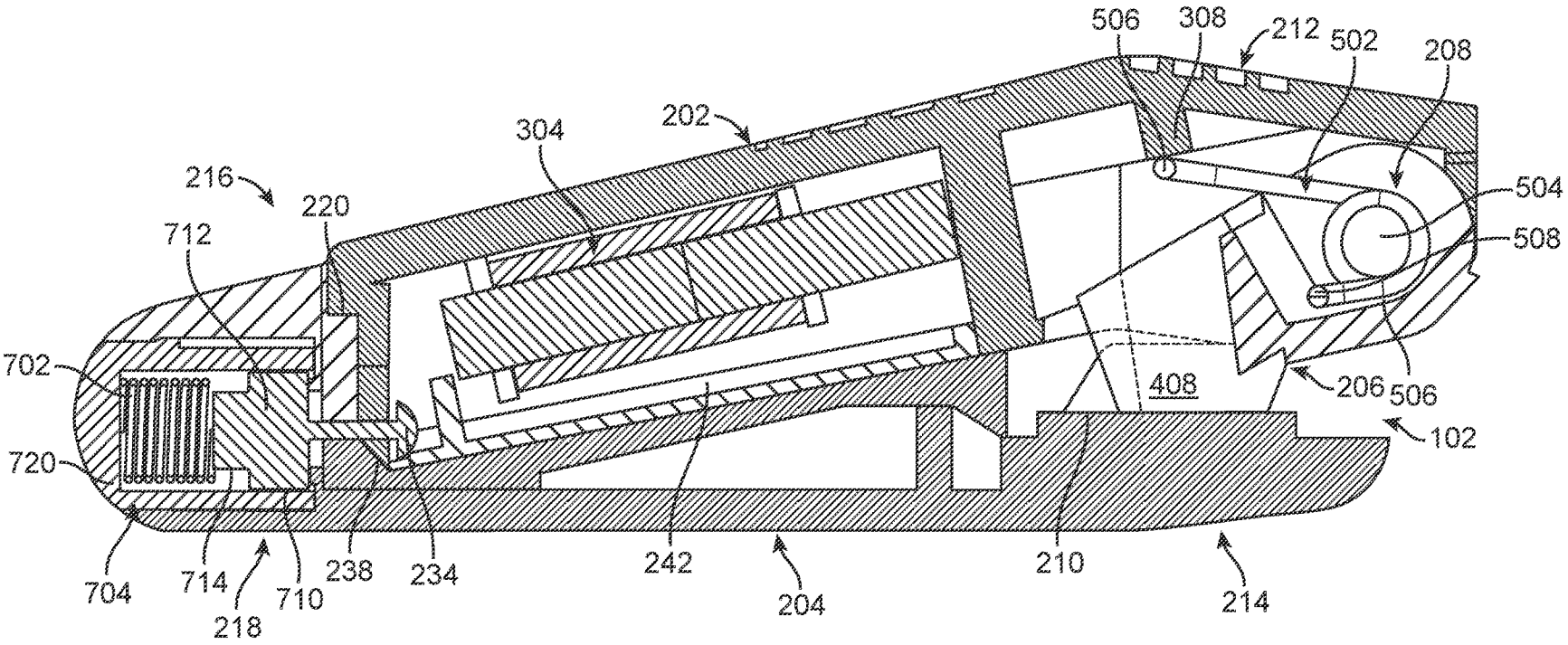
Figure 2K:
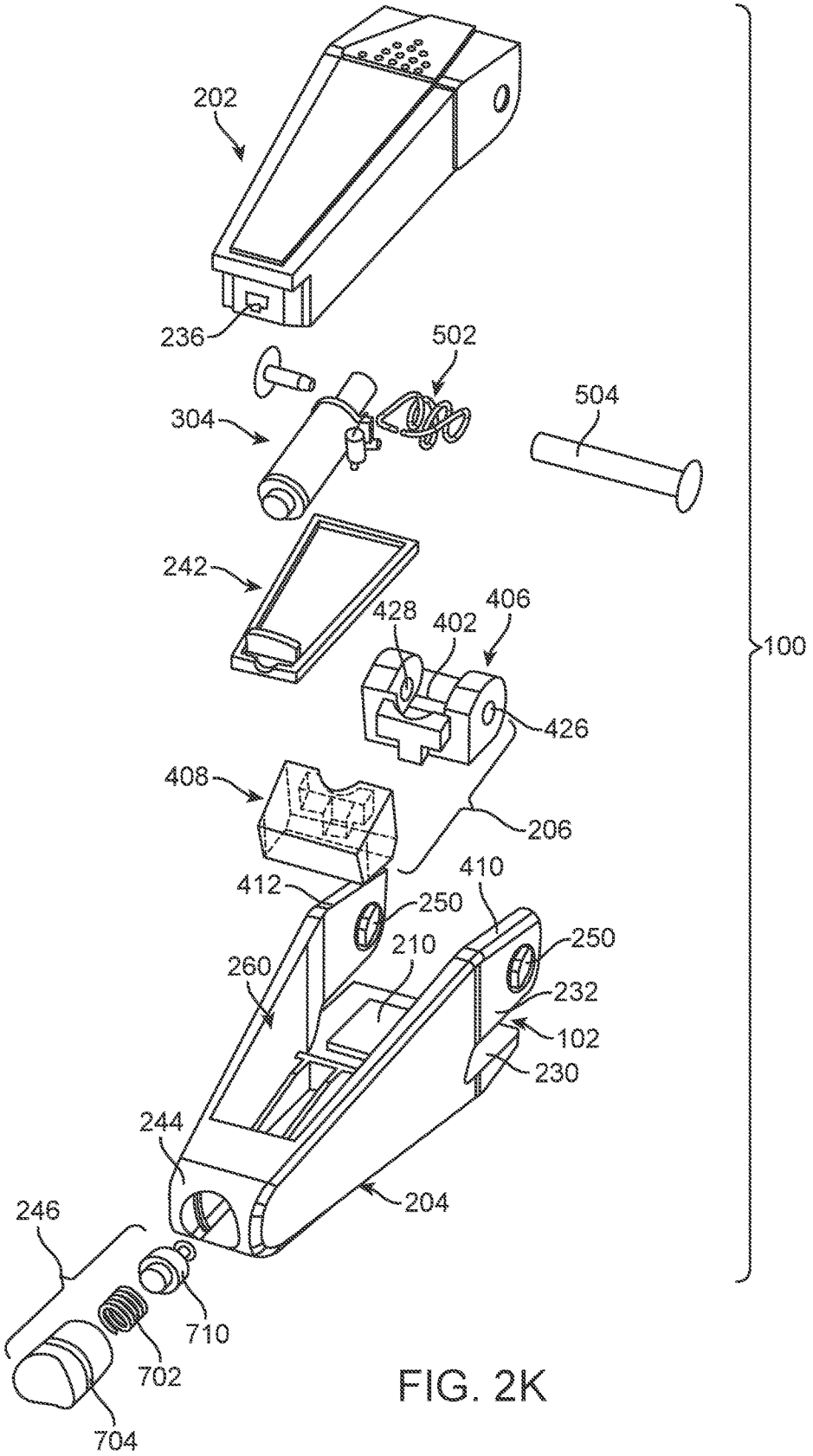

FIGS. 2A to 2K are non-limiting, exemplary illustrations of various views of the EAS tag illustrated in FIG. 1 in accordance with one or more embodiments of the present invention, with FIG. 2J illustrating a sectional view and FIG. 2K and exploded view. As illustrated, EAS tag 100 includes a first member 202 that moves along a reciprocating path 222 from open position (FIGS. 2A to 2G) to a fixed, locking position (FIGS. 2H and 2I) with a second member 204. When moving along path 222, first member 202 moves with it retainer 206 within opening 102 towards a pad 210 associated with the second member 204, with article 104 secured between retainer 206 and pad 210 within opening 102 when first member 202 is locked at the predetermined, locking position. Therefore, according to one or more embodiments of the present invention, first member 202 has a specified locking position (FIGS. 2H and 2I) in relation to second member 204 for securely engaging EAS tag 100 with article 104. Accordingly and as further detailed below, the pressure exerted at the tag engagement points of retainer 206 and pad 210 experienced by article 104 is no longer proportional to the amount of force exerted by a user, but is related to the amount of force exerted at a fixed locking position of first member 202 in relation to second member 204 and the article size (e.g., thickness).

As further illustrated in FIGS. 2A to 2K, EAS tag 100 is comprised of first member 202 that is levered in relation to second member 204 at a fulcrum 208. That is, first member 202 is levered in relation to second member 204 at hinge 208 on which first member 202 rests and on which first member 202 pivots against a force of a biasing mechanism 502 (FIG. 2G) when locked with second member 204, providing a mechanical biasing scheme that generates a holding strength that is maintained under forces that attempt to separate first member 202 from second member 204.

First member 202 has a first end generally indicated by reference 212 that is associated with a first end 214 of second member 204 and a second end 216 that locks with a second end 218 of second member 204 when first member 202 is moved along path 222 to the predetermined locking position. Second end 216 of first member 202 includes an extended top flange 220 that enables first member 202 to become generally flush with an edge 248 of second end 218 of second member 204 (best illustrated in FIG. 2H). The extend flange or lip 220 functions to prevent tampering with an exposed lock member 234 of a lock mechanism by closing a gap between the second end 216 and edges 248 of respective first and second members 202 and 204, which blocks and prevents insertion of tools within the gap to pry open the tag. Second end 216 of first member 202 further includes a beveled or angled surface 238 that function as a chamfered side to guide lock member 234 of the lock mechanism within a keeper 236 (configured as a hole). Therefore, EAS tag 100 includes the lock assembly 246 accommodated within section 244, with first member 202 including keeper 236 of the lock mechanism and second member 204 including lock assembly 246 of the lock mechanism, with lock member 234 of lock assembly 246 locking with keeper 236 to maintain first and second members 202 and 204 in a locked position (FIGS. 2H and 2I). It should be noted that the term "lock mechanism" typically connotes or requires a "key" of a particular format to operate however, in the context of the present invention and as further detailed below in relation to one or more embodiments disclosed, that "key" may be a magnetic detacher in a form of a magnet with sufficient magnetic strength to "unlock" or "unlatch" the locking mechanism.

As further illustrated, in this non-limiting, exemplary instance, it is second member 204 that includes opening 102 for receiving article 104. The opening 102 has a height 224 of sufficient span to allow insertion of articles with various thicknesses and a width 226 and depth 228 of sufficient expanse to allow insertion of adequate amount of material of article 104 for a stronger grip. Opening 102 must have sufficient size to accommodate article 104 while maintaining the structural integrity of second member 204. In particular, dimensions of opening 102 should be of sufficient size to maintain the structural integrity of lower "jaw" portion 230. Stated otherwise, since there is no support between lower jaw 230 and upper jaw 232, when article 104 is inserted in between jaws 230 and 232 and first member 202 is locked in position in relation to the second member 204, the exerted force experienced by lower and upper jaw portions 230 and 232 may flex and break one or both lower or upper jaw portions 230 or 232 if dimensions of lower jaw 230 or upper jaw 232 are not sufficiently sized to withstand the exerted pressures.

First member 202 has a height 254 and a width 256 that vary from first end 212 to second end 216 along a longitudinal axis 258 of EAS tag 100, generally commensurate with variations in a height 252 and a width 404 (FIG. 6) of second member 204 from first end 214 of second member 204 to second end 216. In this non-limiting, exemplary instance, the sizes of the dimensions of first member 202 are smaller than that of second member 204, which enable second member 204 to accommodate the first member 202 into a cavity 260 of second member 204 when first member 202 is locked with second member 204 (best illustrated in FIGS. 2H and 2I).

Figure 3A:
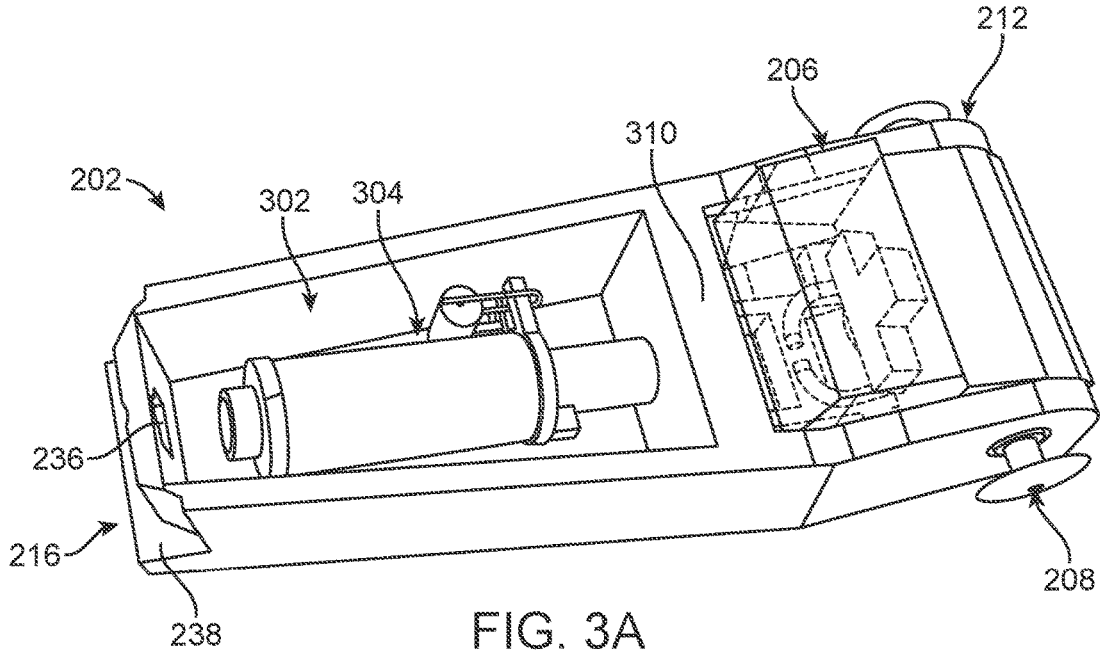
FIGS. 3A and 3B are non-limiting exemplary illustrations of a first member of the theft-deterrent tag illustrated in FIGS. 1A to 2K in accordance with one or more embodiments of the present invention.
Figure 3B:
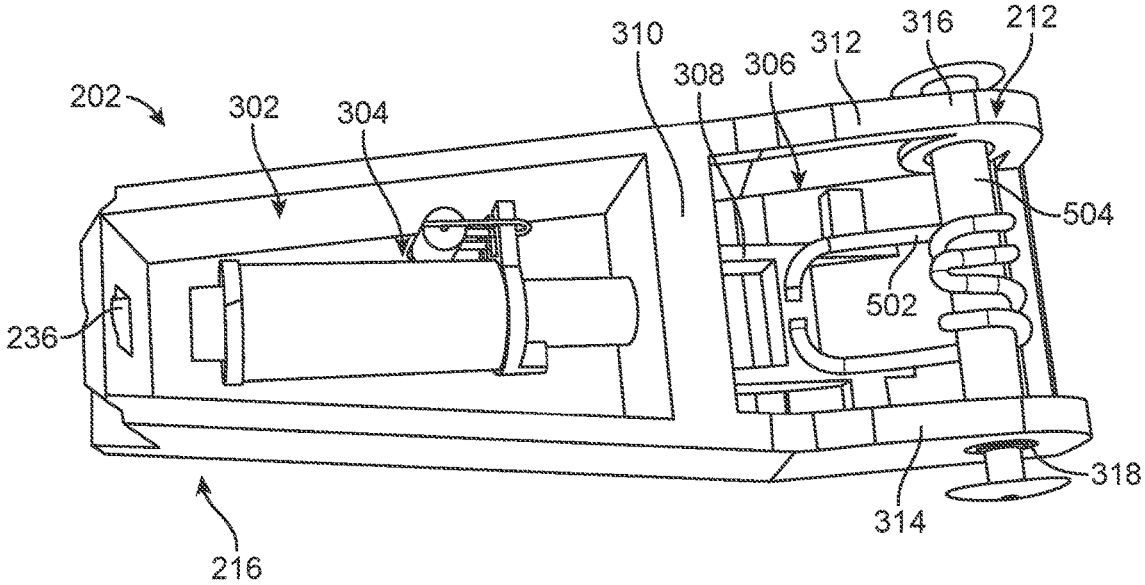

FIGS. 3A and 3B are non-limiting exemplary illustrations of a first member of the EAS tag illustrated in FIGS. 1A to 2K in accordance with one or more embodiments of the present invention. First member 202 includes a first section cavity 306 that accommodates retainer 206 and is associated with second member 204, and a second section cavity 302 (generally covered over by a cover 242) that accommodates a marker 304. In general, one or more markers 304 accommodated within one or both of first member 202 or second member 304 may comprise of inductor/capacitor antenna configurations tuned to different frequencies that may function in response to different types of interrogation surveillance signals (e.g., AM, FM, RF, etc.).

First section cavity 306 is wider than second section cavity 302 for added structure support and for accommodating wider opening 102 for receiving an article. The wider first section 306 in relation to the wider first section of the second member 204 provide wider expanse opening to receive a greater portion of article for a more secure grip. First section cavity 306 further includes internal reinforcing ridges 308 for added structure strength to improve the structural integrity of member 202 and further, provide a support for a biasing mechanism 502. First section cavity 306 is divided from second section cavity 302 by a sectional wall 310 that protects marker 304 from being tampered from outside. First section cavity 306 also has lateral walls 312 and 314 with holes 316 and 318 that receive a hinge pin 504, which securely and moveably hinges first member 202 with second member 204, including retainer 206 (and biasing mechanism 502) with first member 202.

Figure 4A:
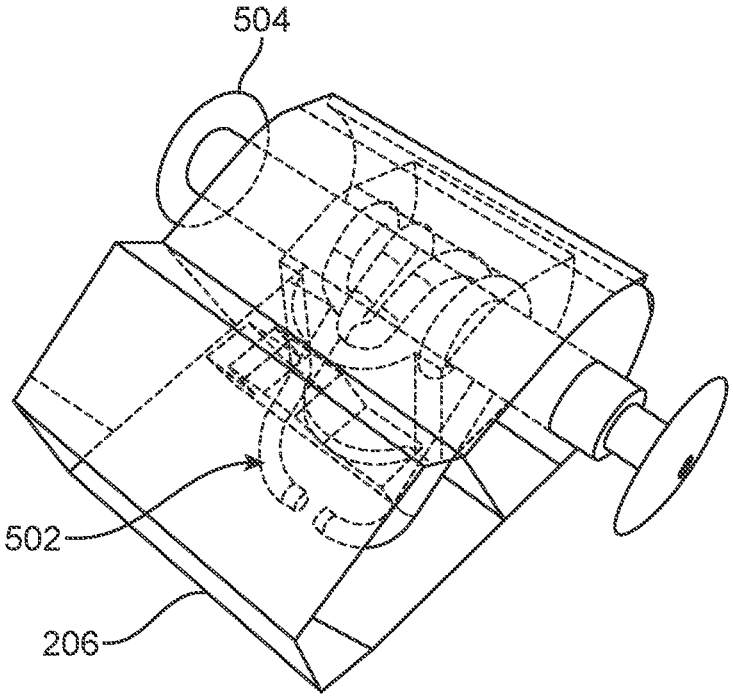
FIGS. 4A to 4F are non-limiting, exemplary illustration of various views of a retainer in accordance with one or more embodiments of the present invention.
Figure 4B:
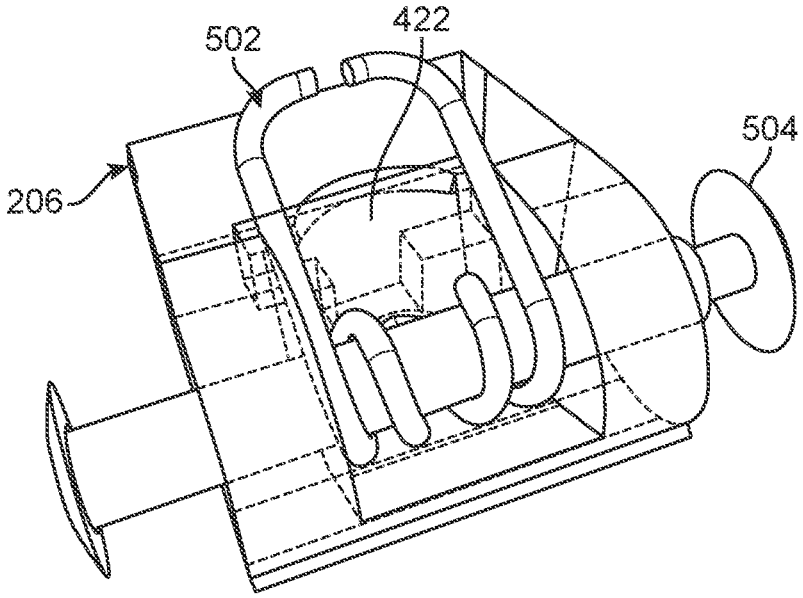
Figure 4C:
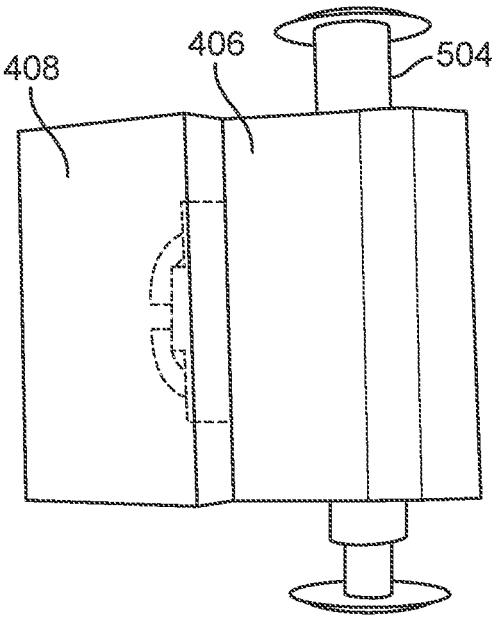
Figure 4D:
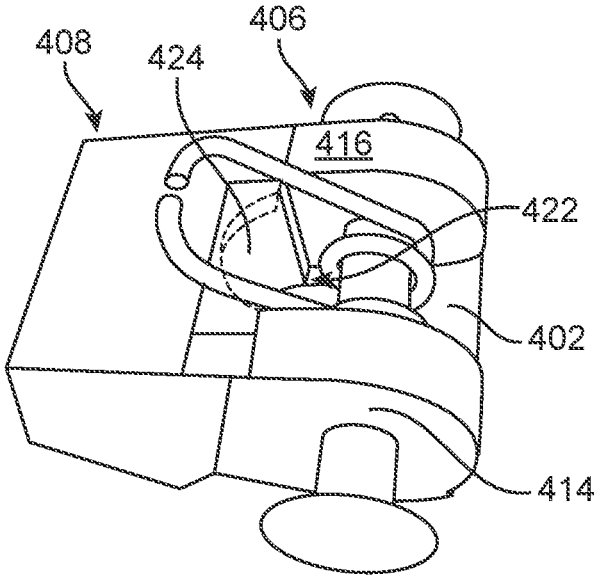
Figure 4E:
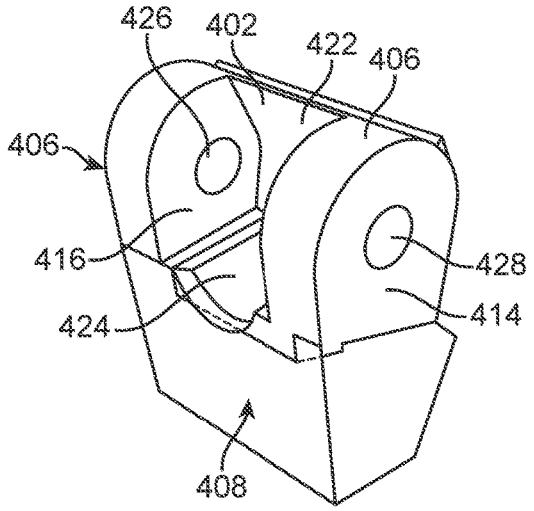
Figure 4F:
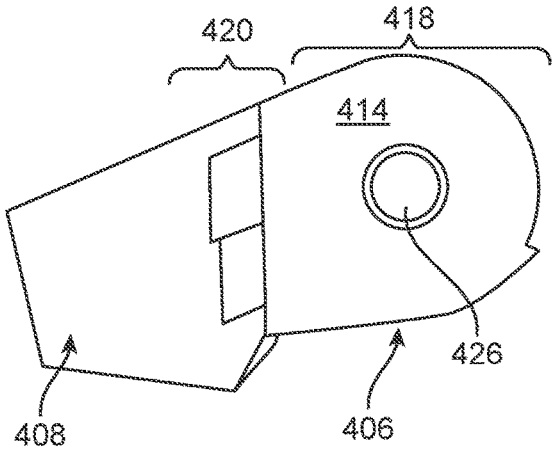
Figure 5:
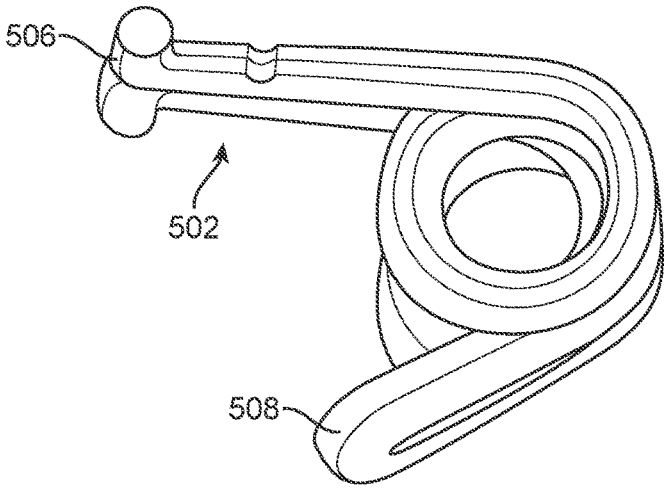
FIG. 5 is a non-limiting, exemplary illustration of a biasing mechanism in accordance with one or more embodiments of the present invention.

FIGS. 4A to 4F are non-limiting, exemplary illustration of various views of a retainer in accordance with one or more embodiments of the present invention, with FIG. 5 showing a non-limiting, exemplary illustration of a biasing mechanism. As illustrated in FIGS. 4A to 5, in this non-limiting, exemplary instance, retainer 206 is movably associated with first member 202 by hinge pin 504. As indicated above in relation to FIGS. 2A to 2I, retainer 206 and pad 210 form a gap between which article 104 is inserted, with a size of the gap defined by a position of retainer 206. As indicated above with respect to first member 202 and further detailed below with respect to second member 204, first member 202 is associated with second member 204 by hinge pin 504 (of hinge 208) via first set of openings 316 and 318 on first lateral walls 312 and 314 of first member 202, a second set of opening 250 on second lateral walls 410 and 412 of second member 204, and a third set of openings 426 and 428 on retainer 206.

Retainer 206 is comprised of a frame 406 that is covered by a grip portion 408, generally comprised of rubber, which adds firm bulk and added protection to prevent damage to the secured article. Frame 406 is comprised of a first portion 418 that includes first and second lateral supports 414 and 416, a second portion 420 that forms a support (or skeletal) structure (generally the same material as frame 406) for supporting grip portion 408, and a cavity 422 defined by first and second lateral supports 414 and 416 and a side 424 of second portion 420. First and second lateral supports 414 and 416 of frame 406 include openings 426 and 428 for associating frame 406 with first member 202 by hinge pin 504. Cavity 422 of frame 406 accommodates biasing mechanism 502. That is, retainer 206 includes biasing mechanism 502 that generates a grip force for securing and holding article when first member 202 is moved to the fixed locking position in relation to second member 204. A first end 506 (FIG. 5) of biasing mechanism 502 is associated with a base 402 of cavity 422 and a second end 508 of biasing mechanism 502 is associated with an interior surface 308 of first member 202 (best illustrated in FIG. 2G), with biasing mechanism 502 secured with first member 202 by hinge pin 504. When first member 202 is moved to its fixed, locking position in relation to second member 204, end 506 of biasing mechanism 502 pushes against the interior surface of first member 202 while the other end 508 pushes against base 402 of cavity 422. In this non-limiting example, the biasing mechanism 502 is a resilient member comprised of a torsion spring. When first member 202 is in fixed, locking position, torsion spring 502 is twisted with stored mechanical energy, which exerts a force (actual torque) in the opposite direction, proportional to the amount by which the spring 502 is twisted. When first member 202 is locked at a predetermined locking position to second member 204, the lock mechanism (detailed below) interlocking the two members 202 and 204 counters the exerted force from the biasing mechanism 502 to maintain first member 202 in a fixed position against the exerted force of the spring 502. It should be noted that the compression force experienced at a position between retainer 206 and pad 210 of second member 204 increases when article 104 is secured between the two. In general, second member 204 includes padding 210 for improved grip of article 104 by retainer 206 and added cushion for preventing damage to article.

Figure 6:
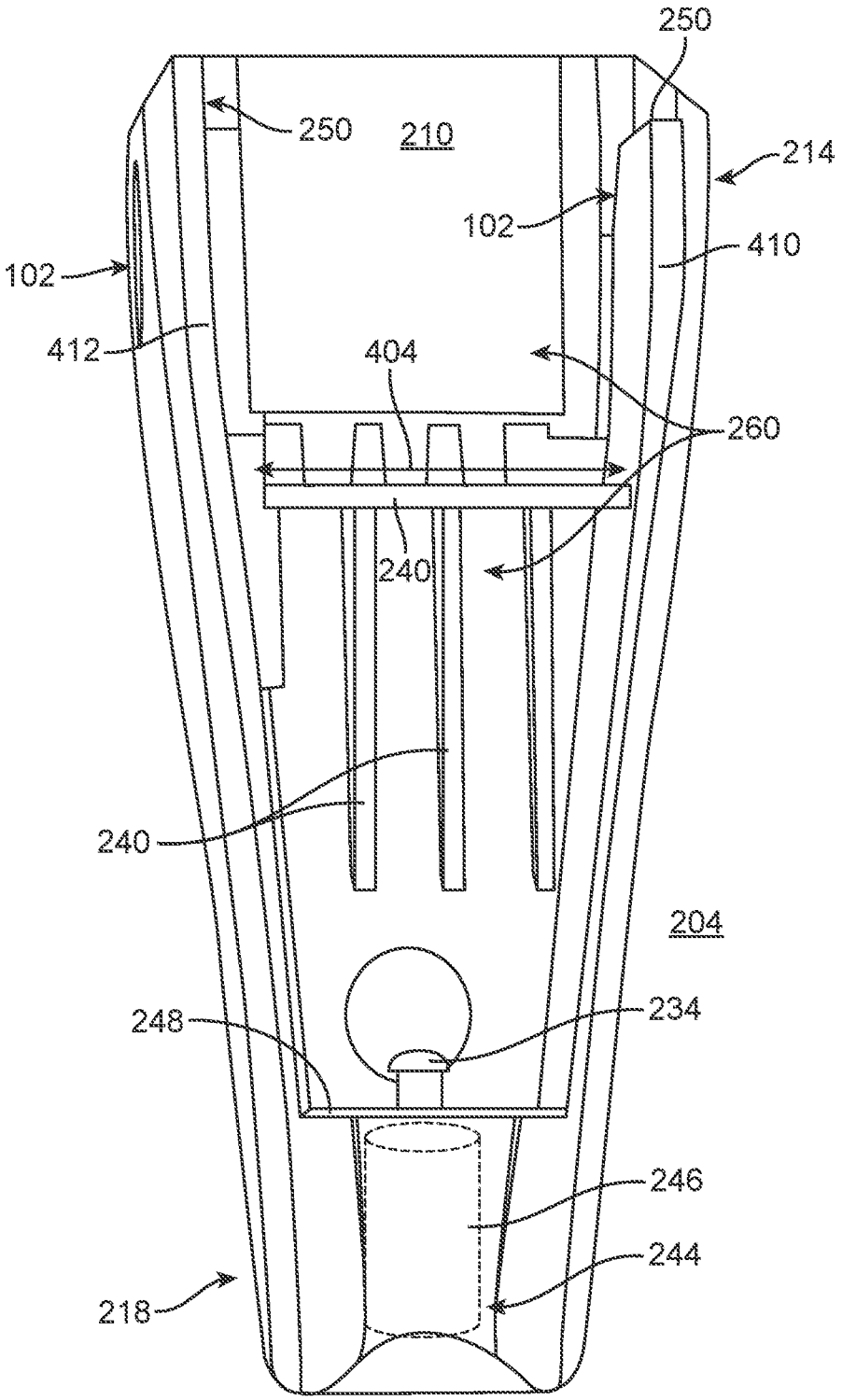
FIG. 6 is a non-limiting, exemplary illustration of a second member of the theft-deterrent tag in accordance with one or more embodiments of the present invention.
Figure 7A:
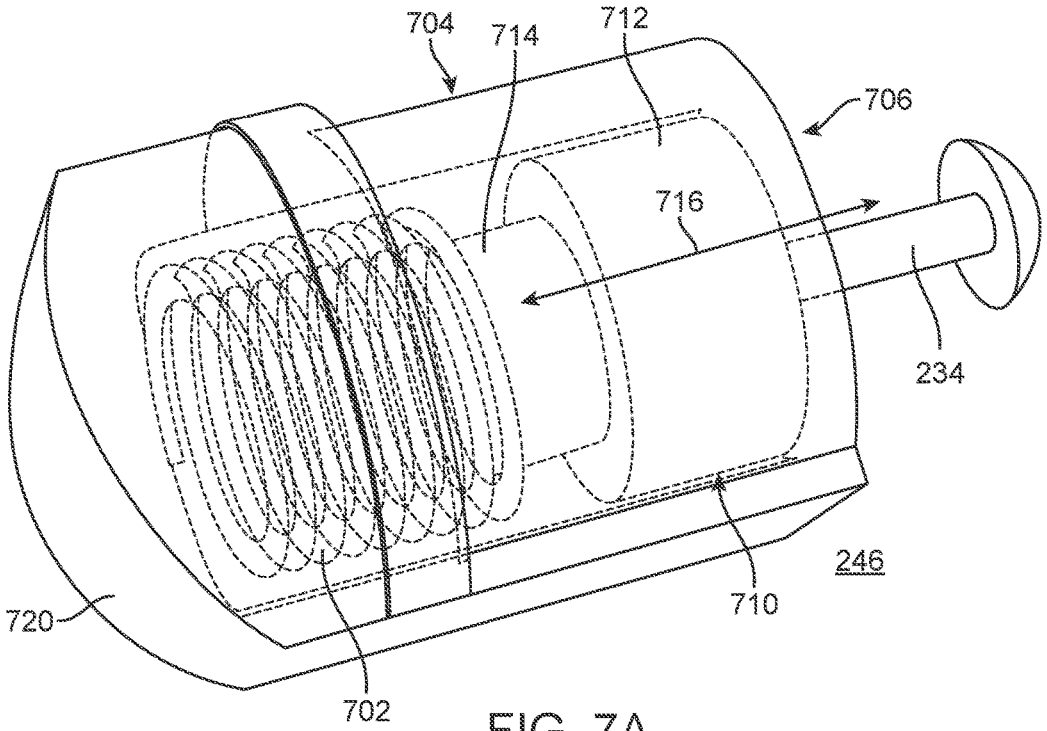
FIGS. 7A and 7B are non-limiting, exemplary illustration of locking assembly of a lock mechanism in accordance with one or more embodiments of the present invention.
Figure 7B:
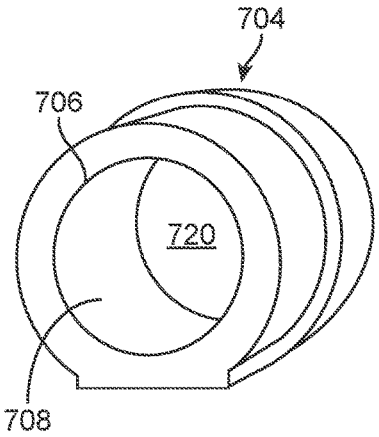

FIG. 6 is a non-limiting, exemplary illustration of a second member of EAS tag in accordance with one or more embodiments of the present invention, with FIGS. 7A to 7B showing a non-limiting, exemplary illustration of locking assembly of a lock mechanism. As illustrated in FIGS. 1 to 7B, second member 204 includes cavity 260 that accommodates pad 210 at first end 214 and includes internal reinforcing ridges 240 for added structure strength to improve the structural integrity of the member 204. Cavity 260 has lateral walls 410 and 412 with holes 250 at upper portion (upper "jaw") 232 at first end 214 that receive hinge pin 504, which securely and moveably hinges second member 204 with first member 202. Lateral walls 410 and 412 end at second end 218 to form section 244, which accommodates lock assembly 246 of the lock mechanism.

As illustrated in FIGS. 7A to 7B, lock assembly 246 is comprised of a resilient member 702 that forces locking member 234 of a locking probe 710 to lock within the keeper 236 of first member 202. The resilient member 702 and the locking probe 710 are accommodated within a cavity 708 of a generally cylindrically member 704 (with a closed end 720), with locking member 234 extending from a hole 706 of the member 704. The resilient member 702 is formed of an elongated cylindrical shaped helical spring that biases the locking probe 710 at portion 714 of engagement section 712 of the locking probe 710 towards keeper 236 along a linear reciprocating path 716. Accordingly, the locking probe 710 includes locking member 234 that is biased to a protruded position by the spring 702 (out from hole 706 and section 244 of second member 204), contacts the beveled surface 238 of first member 202, is progressively forced to a partially retracted position, and is eventually released back to a fully protruded position and snapped into keeper 236 when first member 202 is moved to the fixed locking position, whereby locking member 234 of locking probe 710 interlocks with keeper 236 such that insertion into keeper 236 is allowed, but extraction is not.

To disengage first member 202 from second member 204, locking probe 710 is retracted, released, and disengaged from the interlocked and engaged position within the keeper 236 when the force exerted by the resilient member 710 is reversed. That is, locking member 234 of locking probe 710 is released and disengaged from the keeper 236 when the force exerted by the resilient member 710 is reversed, with the reversed force pulling the locking probe 710 and hence, the locking member 234 out and away from the keeper 236, against the spring 702. That is, to release article 104, section 244 of the EAS tag 100 is brought into physical contact with well-known suitable (in terms of magnetic strength, for example) magnetic detacher that enables the release and removal of the free leading end 234 from keeper 236. The magnetic detacher magnetically pulls-in the locking probe 710 in the reciprocating path 716 against the push of the resilient member 702 (compresses the illustrated spring 702) to thereby pull-in the probe 710 and release the free leading end 234 to release first member 202 from second member 204.

Figure 8A:
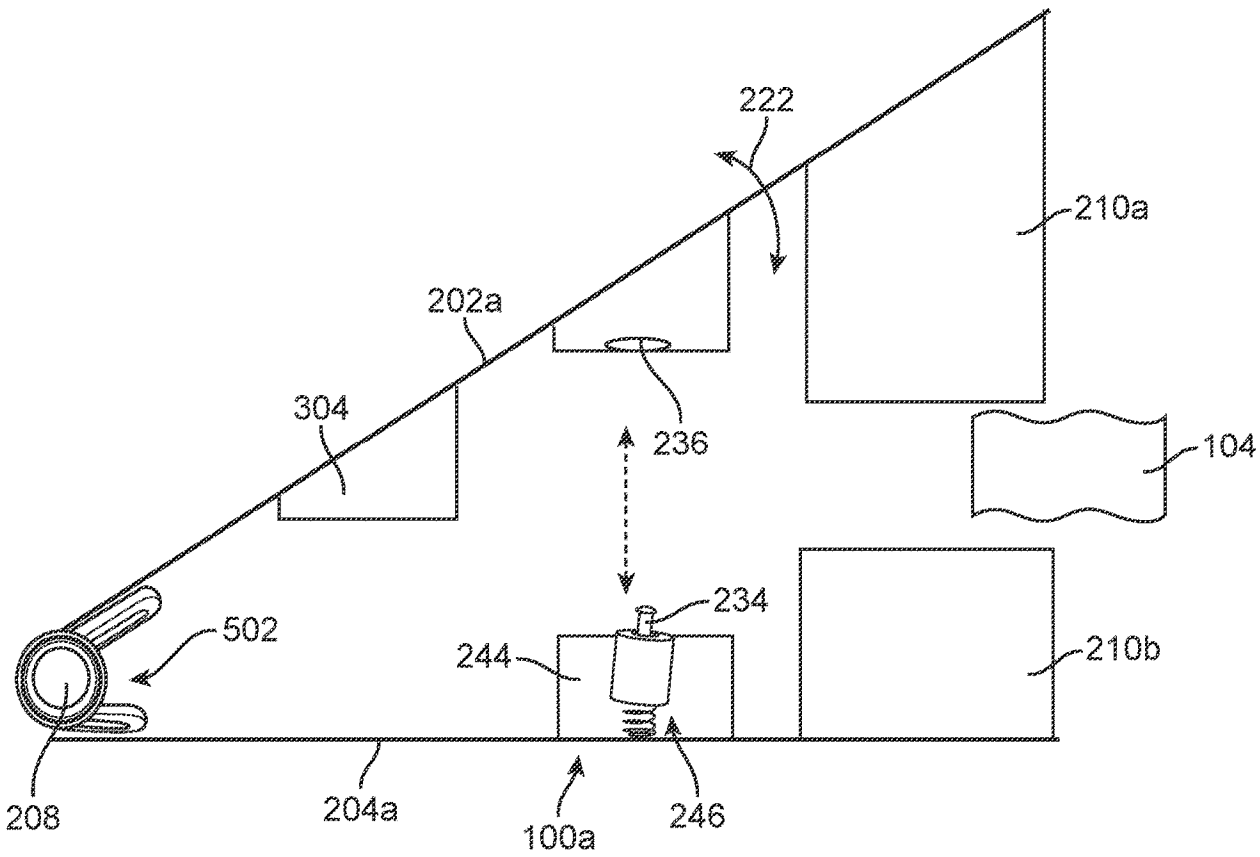
FIGS. 8A and 8B are non-limiting, exemplary illustration of the theft-deterrent tag in accordance with one or more embodiments of the present invention.
Figure 8B:
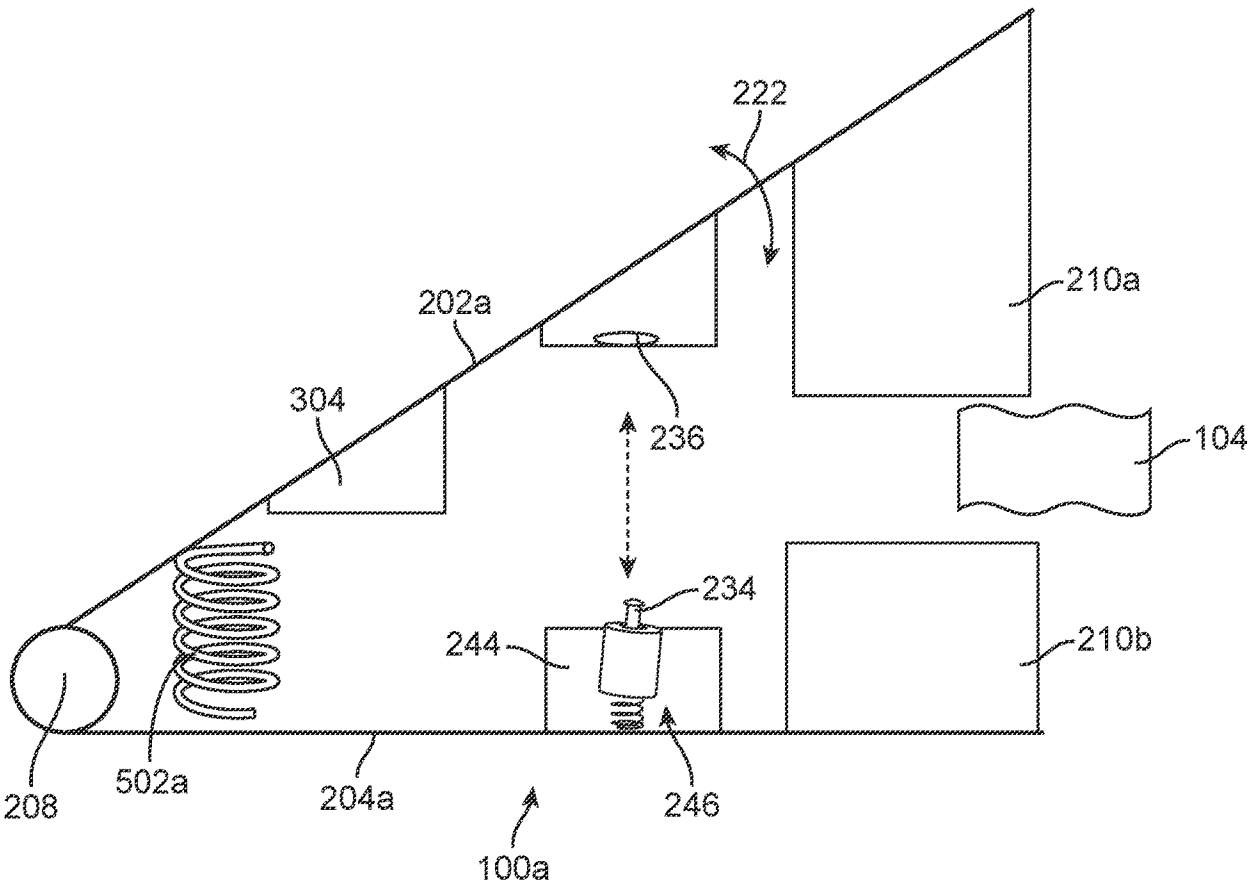

FIGS. 8A and 8B are non-limiting, exemplary illustrations of a profile of an EAS tags in accordance with another embodiment of the present invention. EAS tag 100*a* illustrated in FIGS. 8A and 8B includes similar corresponding or equivalent components, interconnections, functional, operational, and or cooperative relationships as EAS tag 100 that is shown in FIGS. 1 to 7B, and described above. Therefore, for the sake of brevity, clarity, convenience, and to avoid duplication, the general description of FIGS. 8A and 8B will not repeat every corresponding or equivalent component, interconnections, functional, operational, and or cooperative relationships that has already been described above in relation to EAS tag 100 that is shown in FIGS. 1 to 7B. As illustrated in FIGS. 8A and 8B, EAS tag 100*a* comprises two pads 210*a* and 210*b* at a distal open end of EAS tag 100*a* instead of using retainer 206 and having a "jaw" like opening 102. EAS tag 100*a* further repositions lock mechanism at a generally center portion of members 202*a* and 204*a* of EAS tag 100*a*, with the locking assembly 246 associated with member 204*a* and a keeper 236 associated with the member 202*a*. In FIG. 8B, the torsion spring 502 is replaced by cylindrically shaped helical spring 502*b*.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A theft-deterrent tag, comprising:

a first member that has a fixed locking position in relation to a second member for securely engaging the theft-deterrent tag with an article;

the first member has a first end that is levered in relation to an upper section of a first end of the second member at a fulcrum defined by a hinge against a force of a biasing mechanism;

the upper section of the first end of the second member defines an upper jaw portion and a lower section of the first end of the second member defines a lower jaw portion, with upper and lower jaw portions defining a fixed opening at the first end of the second member for securing the article within the opening when a retainer engages the article within the opening and the first member is locked in relation to the second member against the biasing force of the basing mechanism;

the first member has a second end that locks with a second end of the second member when the first member is moved to the fixed locking position, resulting in a holding strength that is maintained under biasing forces of the biasing mechanism that attempt to unlock the first member from the second member;

wherein: pressure exerted at tag engagement points and experienced by the article is commensurate with force exerted at the fixed locking position of the first member in relation to the second member and the article size.

2. The theft-deterrent tag as set forth in claim 1, further comprising:

the retainer is associated with the first member is movable to a position for engagement with the article;

with engagement having sufficient strength to secure and maintain the article.

3. The theft-deterrent tag as set forth in claim 2, wherein:

the retainer and the second member form a gap between which an article is inserted, with a size of the gap defined by the position of the retainer.

4. The theft-deterrent tag as set forth in claim 2, wherein:

the retainer is comprised of a frame that is covered by a grip portion.

5. The theft-deterrent tag as set forth in claim 4, wherein:

the frame is comprised of:

a first portion that includes first and second lateral supports;

a second portion that forms a support structure for supporting the grip portion; and a cavity defined by the first and second lateral supports and a side of the second portion.

6. The theft-deterrent tag as set forth in claim 4, wherein:
the first and second lateral supports of the frame include openings for associating the frame with the first member.

7. The theft-deterrent tag as set forth in claim 4, wherein:
the cavity of the frame accommodates the biasing mechanism.

8. The theft-deterrent tag as set forth in claim 4, wherein:
a first end of the biasing mechanism is associated with a base of the cavity and a second end of the biasing mechanism is associated with an interior surface of one of the first or second members, with the biasing mechanism secured with one of the first or second members by a hinge pin.

9. The theft-deterrent tag as set forth in claim 2, wherein:
the second member includes padding for improved grip and added cushion for preventing damage to the article.

10. The theft-deterrent tag as set forth in claim 1, wherein:
the hinge includes a hinge pin.

11. The theft-deterrent tag as set forth in claim 1, wherein:
the first member has a first end that is hinged to a first end of a second member with the first member having a second end that is free;
one of the first or second members including a lock assembly of a lock mechanism and another of the second or first members including a keeper of the lock mechanism, with a lock member of the lock assembly locking onto the keeper to maintain the first and second members in a locked position.

12. The theft-deterrent tag as set forth in claim 1, wherein:
the first member is associated with the second member by a hinge pin;
the hinge pin is associated with:
a first set of openings on first lateral walls of the first member;
a second set of opening on second lateral walls of the second member, and
a third set of openings on the retainer.

13. The theft-deterrent tag as set forth in claim 1, wherein:
the first member includes:
a first section that accommodates the retainer and is associated with the second member, and
a second section that accommodates a marker.

14. The theft-deterrent tag as set forth in claim 13, wherein:
the first section is wider than the second section for added structure support and for accommodating wider opening for receiving an article.

15. The theft-deterrent tag as set forth in claim 13, wherein:
the retainer includes the biasing mechanism that generates a grip force for securing and holding the article when the first member is moved to the fixed locking position in relation to the second member.

16. The theft-deterrent tag as set forth in claim 1, further comprising:
one or more markers accommodated within one or both of the first member or the second member.

17. A theft-deterrent tag, comprising:
a first member that is levered in relation to a second member at a fulcrum at a first end of the first member and a first end of the second member;
the first member accommodates a marker, forming an Electronic Article Surveillance (EAS) tag;
the first member includes:
a keeper of a lock mechanism at a second end of the first member for allowing a lock member associated with the second member to lock onto the keeper and lock the first member in a fixed locking position in relation to the second member; and
a retainer for engaging an article, with the retainer accommodating a biasing mechanism that enables the levered relationship between the first member and the second member;
the second member includes an opening for securing the article when the retainer engages the article and the first member is locked in relation to the second member against a biasing force of the basing mechanism;
the opening is defined by an upper section of the first end of the second member, forming an upper jaw portion of the opening and a lower section of the first end of the second member, forming a lower jaw portion.

18. The theft-deterrent tag as set forth in claim 17, wherein:
the second member includes internal reinforcing ridges to improve structural integrity.

19. The theft-deterrent tag as set forth in claim 17, wherein:
the second member includes a cushiony pad at a first end that in combination with the retainer form engagement points of a grip mechanism.

20. The theft-deterrent tag as set forth in claim 17, wherein:
one or more markers may be used with each tuned to different frequencies.

21. The theft-deterrent tag as set forth in claim 17, wherein:
the keeper on the first member is comprised of a hole that receives the lock member.

22. The theft-deterrent tag as set forth in claim 17, wherein:
a second end of the first member includes an extended top flange, enabling the first member be flush with the second member and prevent tampering with the lock mechanism;
the second end of the first member further includes a beveled surface that function as a chambered side to guide a lock member within the keeper.

* * * * *